United States Patent [19]

Anderson

[11] Patent Number: 4,949,437

[45] Date of Patent: Aug. 21, 1990

[54] SHOELACE KNOT RETAINING APPARATUS

[76] Inventor: Travis B. Anderson, 4503 Heron St., Gulfport, Miss. 39501

[21] Appl. No.: 378,009

[22] Filed: Jul. 11, 1989

[51] Int. Cl.[5] ..... F16G 11/00

[52] U.S. Cl. ..... 24/712.2; 24/712.6

[58] Field of Search ..... 24/117 R, 118, 119, 24/120, 121, 143 A, 163 K, 178 R; 36/50; 224/163

[56] References Cited

U.S. PATENT DOCUMENTS

| | | | |
|---|---|---|---|
| 303,549 | 8/1884 | Snyder | 24/120 |
| 528,464 | 10/1894 | Craig | 24/119 |
| 915,176 | 3/1909 | Hicks | 24/119 |
| 960,013 | 5/1910 | Highfield | 24/119 |
| 1,599,920 | 9/1926 | Pryor | 224/163 |
| 2,358,351 | 9/1944 | Segal | 24/178 R |
| 2,597,170 | 5/1952 | Oldal | 224/163 |
| 3,418,733 | 12/1968 | Tyrrell, Sr. et al. | 24/117 R |
| 4,403,375 | 9/1983 | Blum . | |
| 4,485,529 | 9/1984 | Blum . | |
| 4,545,138 | 10/1985 | Blum . | |
| 4,553,293 | 11/1985 | Blum | 24/119 |
| 4,715,094 | 12/1987 | Herdman . | |
| 4,780,936 | 12/1988 | Brecher . | |

FOREIGN PATENT DOCUMENTS

| | | | |
|---|---|---|---|
| 186408 | 12/1936 | Switzerland | 224/163 |
| 13408 | of 1900 | United Kingdom | 24/119 |
| 17685 | of 1911 | United Kingdom | 24/120 |
| 21989 | of 1912 | United Kingdom | 24/120 |

*Primary Examiner*—Victor N. Sakran
*Attorney, Agent, or Firm*—R. Lewis Gable

[57] ABSTRACT

There is shown a device for retaining a knot of a shoelace. The device comprises a band with proximate and distal ends. The band is made of an elastic material, whereby the band may be stretched from a relaxed length to a stretched length. A rigid tab member comprises a proximate end portion connected to the proximate end of the elastic band, a distal end portion, and a lace slot cut entirely through the rigid tab member. A clip is affixed to the distal end of the elastic band for receiving the distal end portion in an attached state, wherein a force is applied by the elastic band attempting to retract the elastic band from its stretched length to its relaxed length, to maintain the distal end portion of the rigid tab member within the clip, and the knot is maintained in the lace slot and the shoelace clamped between the elastic band and the rigid tab member.

12 Claims, 2 Drawing Sheets

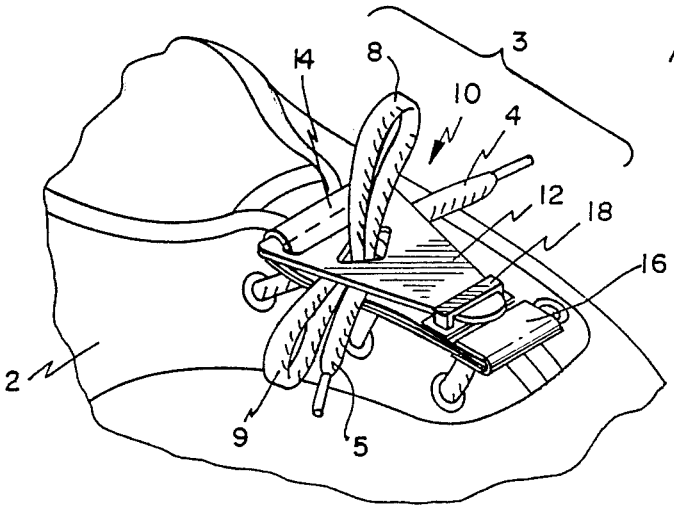
FIG. 1
FIG. 2
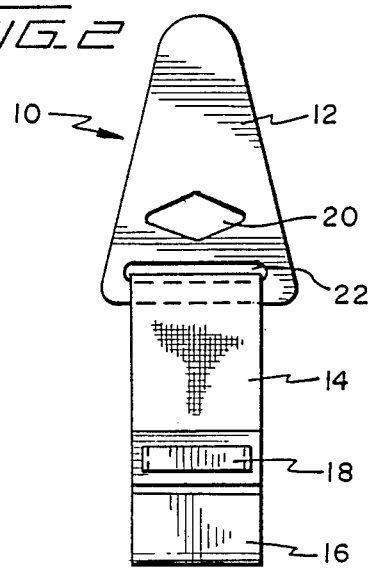
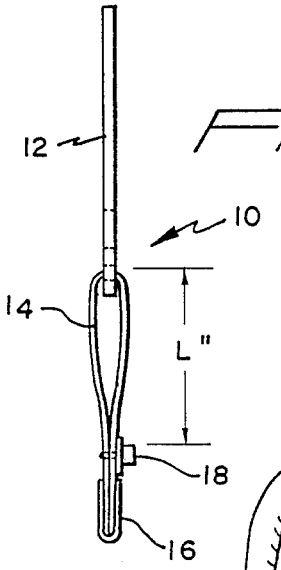
FIG. 3
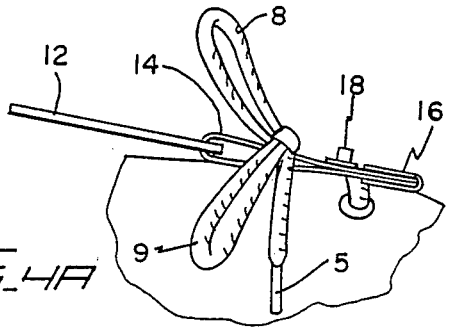
FIG. 4A
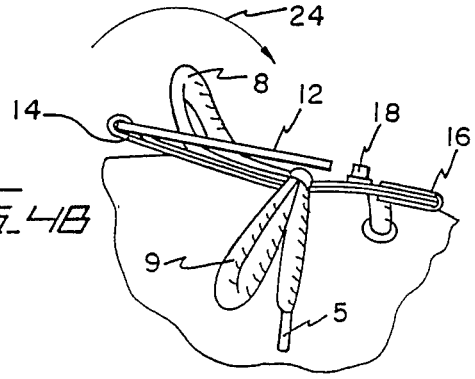
FIG. 4B
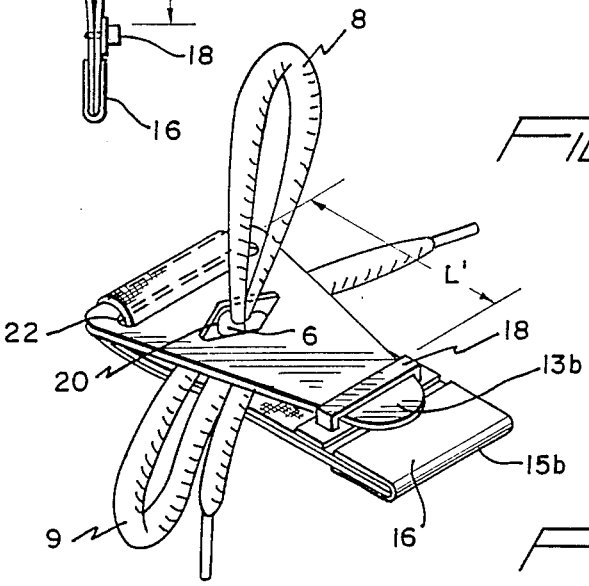
FIG. 5
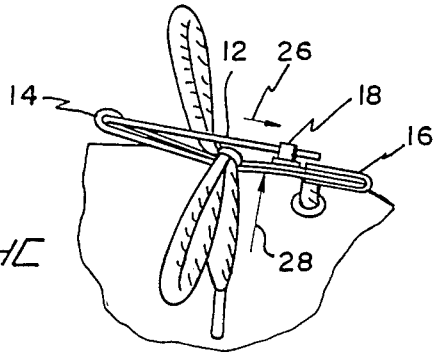
FIG. 4C

SHOELACE KNOT RETAINING APPARATUS

FIELD OF THE INVENTION

This invention relates to an apparatus for securing shoelace knots. More specifically, this invention relates to a shoelace knot retaining device which prevents shoelaces from becoming untied.

DESCRIPTION OF THE PRIOR ART

There have been a number of devices employed to hold shoelaces together or otherwise prevent them from becoming untied. These devices generally have taken four forms: (1) flexible ties that wrap around a shoelace knot, (2) substantially rigid devices that are laced and tied to the knot, (3) substantially rigid devices that enclose and clamp the knot; and (4) modifications to shoes to prevent the knot from becoming untied. These forms will be described further below.

U.S. Pat. No. 4,403,375 of Blum is illustrative of the prior art in which a flexible tie is used to hold or retain a tied shoelace in place. Its FIG. 1 discloses a tying device 10 made of a resilient material and comprising a tongue portion 14 having a plurality of wedge portions 22 and dimples 26 disposed between a tail portion 16 and a base portion 12. The base portion 12 has a slot cut therethrough for receiving the tongue portion 14. In operation, the tongue portion 14 is passed over and under the shoelace knot, forming a closed loop, and then through the slot 28. The bulge of the shoelace knot prevents the wedge portion 22 from slipping through the slot 28. The dimples 26 prevent the knot from slipping out of the loop formed by the tongue portion 14.

U.S. Pat. No. 4,485,529 of Blum is illustrative of a rigid device tied to a knot. Its FIG. 1 discloses a device for securing tied shoelaces comprising a body portion 12, an eyelet member 14 having a neck portion 26 extending from the member 14, and a closed elastic band 16 affixed to the body portion 12 and extending through an eyelet 30 within the eyelet member 14. To use the device, one passes shoelaces through eyelets 28 within the member 14 and ties them in a knot resting on the eyelet member 14. One then stretches the elastic band 16 over the knot and member 14, and loops the elastic band 16 over the body 12 whereby the band 16 loops around the neck portion 26.

An example of a device which encloses a knot is U.S. Pat. No. 4,715,094 of Herdman, which discloses a shoelace knot holder 2 comprised of a top section 6 hinged with a bottom section 24. In operation, one places the knot holder 2 on a shoe and pulls the laces through a pair of shoelace passages 8,10. After the laces are tied in a bow, the ends of the laces are placed over serrated edges 16,18 of the bottom section 24. The top section 6 is closed upon the knot, thereby clamping it.

U.S. Pat. No. 4,545,138 of Blum discloses a shoe 10 with a tongue 12 and laces comprising a hook member 16, and an elastic band 18 having a distal end 20 and a proximate end 24. The distal end 20 of the elastic band 18 is stretched over the knot and hooked to the hook member 16. The force of the elastic band 18 holds the distal end 20 firmly against the hook member 16, and presses it against the tongue 12, thereby pressing against the knot also to prevent it from unraveling.

U.S. Pat. No. 4,780,936 of Brecher discloses footwear 14 with a tongue 12 and laces 40, and a "stay tied" device 10 comprising first and second flexible bands 16,18 which are attached to the tongue 12 in the vicinity of the knot. After the shoelace is tied, the free ends of the first and second flexible bands 16,18 are looped around the knot and fastened together.

The prior art demonstrates the efficacy of clamping the knot to prevent it from becoming untied. However, the devices employed to prevent the knot from becoming untied have suffered from inadequacies including the awkward manner in which the devices are used with the shoe, the complexity and balkiness of the devices, the cost to manufacture the devices and the failure of the devices to securely retain the knot.

The prior art has suggested devices in which the laces must be threaded through the devices before being tied or clamped by a box-like construction. The time and effort necessary to place these devices on the shoe and integrate them with the laces has impaired general acceptance by the public. The prior art also has suggested devices permanently attached to the shoes of the user. Once again, requiring the public to purchase a special pair of shoes has not met with acceptance. The prior art has also suggested using a flexible tying device, which has suffered because it does not adequately secure the knot.

Consequently, it is difficult for parents and children to use these devices. The parent is placed in an awkward position when trying to manipulate these devices when putting a shoe on the child, since using the devices can be complicated and tedious. Given the limited dexterity and mechanical ability of children who would need to use these devices, the child will also have problems installing the devices.

Furthermore, athletes are burdened with the size and complexity of the devices. In an athletic event, an athlete must have complete freedom of movement without fear that the knot will become untied. The size and bulk of the prior art impedes one's movements without securely retaining the knot.

SUMMARY OF THE INVENTION

It is thus an object of this invention to provide a new and improved apparatus to prevent a shoelace knot from becoming untied.

It is a more particular object of this invention to provide a shoelace knot retaining device that is easily attached and removed, yet retains the knot securely without a complex or bulky design.

It is a further object of this invention to provide a shoelace knot retaining device that attaches simply enough for a child to use.

It is also a further object of this invention to provide a knot retaining device that retains a knot securely enough for use in athletic situations where freedom of movement is necessary.

In accordance with these and other objects of this invention, there is disclosed an improved shoelace knot retaining device. In an illustrative embodiment, the knot retaining device comprises a band with proximate and distal ends, the band comprising an elastic material whereby it may be stretched from a relaxed length to a stretched length, a rigid tab member comprising a tab portion, a lace slot, a band slot and a clip affixed to the distal end of the band, whereby the force applied by the elastic band attempting to retract from the stretched state to the relaxed state attaches the rigid tab member to the clip and, whereby the clamping force developed by the band and exerted against the knot maintains the knot between the elastic band and the rigid tab member.

In a further aspect of this invention, the clip is attached a predetermined distance from the band slot. The predetermined distance is greater than the relaxed length, but less than the stretched length of the elastic band.

In a still further aspect of this invention, the lace slot is disposed between the proximate and distal end portions of the tab member and central between the opposing sides thereof.

In a further aspect of this invention, a pocket is affixed to the distal end of the elastic band for releasable receiving a key. The pocket includes a front piece and a back piece. The back piece has a sealable opening to receive and thereafter retain the key.

BRIEF DESCRIPTION OF THE DRAWINGS

These and other objects and advantages of the present invention will become apparent by referring to the following detailed description, and accompanying drawings, in which:

FIG. 1 is a perspective view of the knot retaining device placed about the knot of a shoelace in accordance with the teachings of this invention;

FIG. 2 is a top plan view of the knot retaining device as shown in FIG. 1;

FIG. 3 is a side view of the knot retaining device as shown in FIGS. 1 and 2;

FIGS. 4 are side views illustrating the process of securing or attaching the knot retaining device as shown in FIG. 1, wherein FIG. 4A shows that the knot retaining device is first placed under the shoelace knot, FIG. 4B shows that the knot retaining device is then stretched to allow the tab member to be pulled over the shoelace knot, and FIG. 4C shows that the knot retaining device is finally locked in place about the shoelace knot;

FIG. 5 is an enlarged perspective view of the knot retaining device placed about the knot of a shoelace.

DESCRIPTION OF THE PREFERRED EMBODIMENT

Figure 6A:
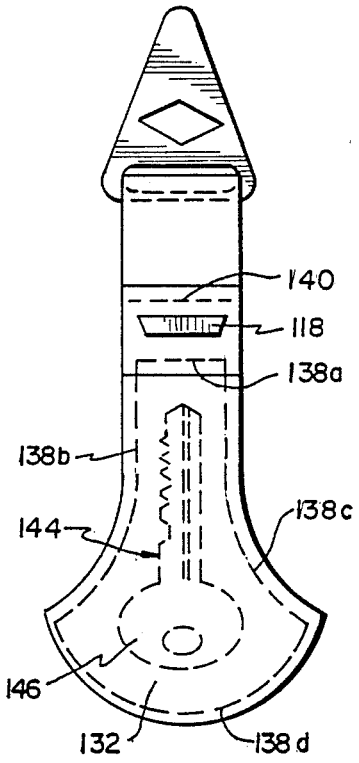
FIGS. 6 A and B are respectively a top plan view and a bottom plan view of a further, preferred embodiment of this invention including a key pocket.

With reference to the drawings and, in particular to FIGS. 1,2, and 5, there is shown, respectively, a perspective, top and enlarged perspective view of a shoe 2, a shoelace 3 having end portions 4 and 5, a shoelace knot 6, a pair of shoelace bows 8,9 and a shoelace knot retaining device 10 in accordance with this invention. The knot retaining device 10 is adapted to secure the shoelace knot 6 in place, whereby the knot 6 cannot be easily or accidentally untied.

The knot retaining device 10 includes a rigid tab member 12 made illustratively of plastic and having respectively proximate and distal end portions 13*a* and 13*b*. A band slot 22 cut entirely through the proximate end portion 13*a* to allow an elastic band 14 to be passed through the band slot 22 and folded over, as shown in FIG. 3, thereby attaching a proximate end of 14*a* the elastic band 14 to the proximate end portion 13*a* of the tab member 12. The band 14 initially rests at a relaxed length, but may be stretched to a stretched length. A distal grip 16, also made of plastic for illustration, attaches the end portions of the elastic band 14 together. For illustration only, the tab member 12 and distal grip 16 could also be made of other lightweight rigid materials, such as wood or lightweight metal, and the distal grip 16 could be attached to the elastic band 14 by glue or staple.

The tab member 12 also includes a lace slot 20 cut entirely therethrough to allow a portion of the shoelace knot 6 and either shoelace bow 8 or 9 to be pulled through the tab member 12, thereby retaining the shoelace knot 6 more securely. The lace slot 20 is cut in a diamond shape to help position the knot 6 centrally of the member 12, i.e., along the minor axis of the diamond as shown in FIG. 5; but, other shapes may also be used. A clip 18 is affixed at a distal end 15*b* of the elastic band 14 for receiving the distal end portion 13*b* of the tab member 12 when the device 10 is wrapped about a shoelace knot 6. Once again, for illustrative purposes, the clip 18 could be made of plastic or other rigid lightweight material and attached to the elastic band 14 by glue or staple.

Referring now to FIGS. 4A–C, there is shown the steps of placing the knot retaining device 10 about the shoelace knot 6. As illustrated in FIG. 4A, the device 10 is first laid on the shoe 2 such that the top of the device 10, as shown in FIG. 2, faces up. The shoelace 3 is then tied in a normal bow knot, with the knot 6 resting on the elastic band 14, preferably in the middle of the elastic band 14. Alternately, the knot 6 could be tied first, and the device 10 then slipped under the knot 6 so that, once again, the knot 6 rests in the middle of the elastic band 14.

As shown by the arrow 24 in FIG. 4B, the tab member 12 is then rotated to permit it to be inserted into the clip 18, and the shoelace bow 8 is passed through the lace slot 20. Alternatively, shoelace bow 9, or both shoelace bows 8 and 9 could be passed through the lace slot 20 instead of just shoelace bow 8. For best results, only one shoelace bow 8 or 9 should be passed through, since a greater force is required to pull end portion 4 or 5 to untie the knot 6 if only one shoelace bow 8,9 is passed through the lace slot 20. The tab member 12 and distal grip 16 are then simultaneously held and pulled apart, thereby stretching the elastic band 14 from its relaxed length to its stretched length.

Finally, as illustrated in FIG. 4C, the distal end portion 13*b* of the tab member 12 is inserted into the clip 18 and the tab member 12 and distal grip 16 are released. The device 10 is secure about the knot 6. The retracting force of the elastic band 14, indicated by arrow 26 in FIG. 4C, forces the end portion 13*b* of the tab member 12 into the clip 18, thereby keeping the tab member 12 secure in the clip 18. As shown in FIG. 3, the clip 18 is spaced a distance L″ from the place where the elastic band 14 is securely connected to the tab member 12, i.e., where the band 14 is passed through the band slot 22. As seen in FIG. 5, the tab member 12 is of a triangular shaped configuration having it's distal end portion 13*b* of a lesser dimension than it's base portion, whereby the distal end portion 13*b* may be received within the clip 18 and inserted a distance until the side edges of the tab member 12 abut the clip 18 and prevent further insertion. The distance L′ from the slot 22 along the tab member 12 to the point where the clip 18 engages and prevents further insertion of the tab member 12. As explained above, the elastic band 14 exerts it's retracting force as shown by arrow 26 to push the distal end portion 13 into the clip 18. The distance L′ is greater than the distance L″, whereby when the distal end portion 13*b* of the tab member 12 is received within the clip 18 in it's attached state, the elastic band 14 is still stretched and therefore tends to retract, exerting it's retracting force as seen by arrow 26 in FIG. 4C. Furthermore in the attached state, the knot 6 is held secure between the tab member 12 and the elastic band 14 by the clamping force exerted upon the tab member 12 by the elastic band 14 as indicated by arroW 28.

It is an important aspect of the invention that the shoelace bow 8 is passed through the lace slot 20. Passing the shoelace bow 8 through the lace slot 20, as shown in FIG. 5, increases the pulling force upon the end portions 4,5 necessary to untie the knot 6, since the clamping force between the tab member 12 and the elastic band 14 prevents the shoelace bow 8 from sliding through the lace slot 20. Thus, the shoelace 3 retains the knot 6 and is less easily untied when the shoelace 3 is accidentally pulled, such as when a child is playing.

It is a further significant aspect of this invention that the retracting force of the stretched elastic band 14 is used to secure the tab member 12 in the clip 18. This provides an easy and effective means of securing the device 10 about the knot. In the prior art as described above, various methods, including passing tongues with serrated edges through a slot, clamping hinged walls, and directly attaching devices to shoes were used to secure the device to the knot. These methods had the disadvantages of not holding the knot securely, being too awkward and complex, and requiring modification to the shoes. By using the retracting force of the elastic band 14, attachment and removal of the device is much simpler, since the tab member 12 has a natural tendency to fit into the clip 18. Consequently, one need only place the tab member 12 in the clip 18 to secure the knot retaining device 10; the retracting force of the elastic band 14 forces the tab member 12 into the clip 18. To remove the device, one need only grasp the tab member 12 and the distal grip 16 and pull them apart so that the tab member 12 no longer fits in the clip 18; the elastic band 14 returns to its relaxed state. Furthermore, the knot 6 is held more securely by the clamping force of the elastic band 14 upon the tab member 12.

Figure 6B:
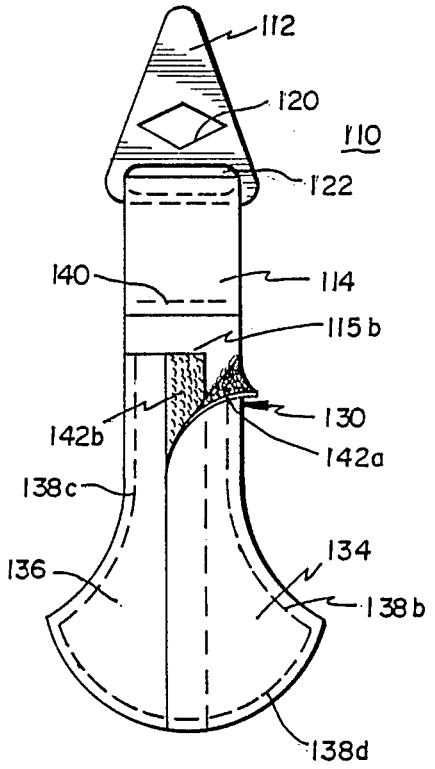

Referring now to FIGS. 6 A and B, there is shown a further preferred embodiment, in which the elements are numbered with similar numbers as the elements of the embodiment shown in FIGS. 1–4 except in the hundred series. The second embodiment of the shoelace retaining device is identified by the numeral 110 and features a key pocket 130, which is attached to the elastic band 114 and is designed to receive and retain a key 144 therein. The key pocket 130 is comprised of three pieces, namely a front piece 132 as particularly shown in FIG. 6A, and a right back piece 134 and a left back piece 136 as particularly shown in FIG. 6B. The key pocket 130 is attached to the elastic band 114 by stitching as will be explained below. In a manner similar to that described above, the tab member 112 is adapted to be received within the clip 118, whereby the shoelace retaining device 110 is adapted to be secured to the shoelace and to retain it's shoelace knot in place.

The front piece 132 is attached to the elastic band 114 by a top edge stitching **138*a* and a top most stitching 140. In turn, the front piece 132 is secured to the right back piece 134 by a side edge stitching 138*c* and part of a bottom edge stitching 138*d*. In similar fashion, the left back piece 136 is secured to the front piece 132 by a side edge stitching 138*b* and a part of the bottom edge stitching 138*d*. As shown in FIG. 6B, the right back piece 134 overlaps the left back piece 136, and has a first strip 142*a* of attaching material, e.g., velcro, secured to an edge portion thereto. A like second strip 142*b* of attaching material is secured to an edge portion of the left back piece 136. The first and second strips 142*a* and *b*releasably engage each other to retain the key 144 within the key pocket 130. Appreciating that the top most portions of each of the right and left back pieces 134 and 136 are not secured to the elastic band 114, permits the right and left back pieces 134 and 136 to be folded back as illustrated in FIG. 6 B to permit insertion of the key 144. Thereafter, the attaching edges 142*a* and 142*b* are attached with each other, whereby the right back piece 134 and the left back piece 136 complete the key pocket 130, thereby retaining the key 134 therein. In that regard, it is noted that the key 144 includes an enlarged, handle portion 146 which prevents the escape of the key 144 through out the unattached top most portions of the pieces 134 and 136. Thus, the second embodiment of the shoelace retaining device 110** permits the user, typically a child, to keep a key in a secure, easily accessible location.

In considering this invention, it should be remembered that the present disclosure is illustrative only and the scope of the invention should be determined by the appended claim.

I claim:

1. A device for retaining a knot of a shoelace, said device comprising:

(a) a band with proximate and distal ends, said band comprising an elastic material whereby said band may be stretched from a relaxed length to a stretched length, (b) a rigid tab member comprising a proximate end portion connected to said proximate end of said elastic band, a distal end portion, and a lace slot cut entirely therethrough said rigid tab member; and (c) a clip affixed to said distal end of said elastic band, said band and clip forming together an opening for receiving said distal end portion in an attached state, wherein a force is applied by said elastic band attempting to retract said elastic band from said stretched length to said relaxed length to urge said proximate end portion of said rigid tab member further into said opening and to maintain said distal end portion of said rigid tab member securely within said clip, and wherein the knot is maintained in said lace slot and the shoelace clamped between said elastic band and said rigid tab member.

2. The device as claimed in claim 1, wherein said tab member further comprises a band slot disposed at its proximate end portion, said elastic band is attached to said rigid tab member by inserting and folding said elastic band through said band slot.

3. The device as claimed in claim 2, wherein the shoelace is inserted through said band slot.

4. The device as claimed in claim 1, wherein said clip is affixed to said distal end by staple.

5. The device as claimed in claim 1, wherein said rigid tab member is made of plastic.

6. The device as claimed in claim 1, wherein said lace slot is of a diamond shape.

7. The device as claimed in claim 1, wherein there is included a pocket affixed to said distal end of said band for releasably receiving a key, said pocket includes a front piece and a back piece, said back piece having a sealable opening to receive and thereafter enclose the key.

8. The device as claimed in claim 7, wherein said back piece includes a right back piece and a left back piece, each of said right and left back pieces having an edge portion overlapping with the other back piece and attaching means secured to each of said overlapping portions.

9. The device as claimed in claim 8, wherein the attaching means of each of said right and left back pieces releasably engages the other of said attaching means to retain the key within said pocket.

10. The device as claimed in claim 9, wherein each of said first and second attaching means comprises a velcro strip.

11. The device as claimed in claim 1, wherein said distal end of said tab member has a first dimension, said tab member has a point intermediate of said distal and proximate ends of said tab member, said intermediate point has a second dimension, and said clip has a third dimension greater than said first dimension and less than said second dimension.

12. The device as claimed in claim 11, wherein the dimensions of said tab member increases from said first dimension to said second dimension of said intermediate point.

* * * * *